United States Patent [19]

Cendre et al.

[11] Patent Number: 4,844,178

[45] Date of Patent: Jul. 4, 1989

[54] DRILLING DEVICE HAVING A CONTROLLED PATH

[75] Inventors: André Cendre, Cosne Sur Loire; Jean Boulet, Paris, both of France

[73] Assignee: SMF International, Cosne Sur Loire, France

[21] Appl. No.: 173,359

[22] Filed: Mar. 25, 1988

[30] Foreign Application Priority Data

Mar. 27, 1987 [FR] France ..... 8704321

[51] Int. Cl.[4] ..... E21B 7/08

[52] U.S. Cl. ..... 175/73; 175/76; 175/325; 166/241

[58] Field of Search ..... 175/61, 76, 73, 267, 175/269, 325; 166/212, 240, 241, 383

[56] References Cited

U.S. PATENT DOCUMENTS

| | | | |
|---|---|---|---|
| 3,123,162 | 3/1964 | Rowley | 175/325 |
| 3,129,776 | 4/1964 | Mann | 175/76 |
| 3,424,256 | 1/1969 | Jeter et al. | 175/76 |
| 4,388,974 | 6/1983 | Jones Jr. et al. | 175/76 X |
| 4,407,377 | 10/1983 | Russell | 175/325 |
| 4,491,187 | 1/1985 | Russell | 175/325 |
| 4,683,956 | 8/1987 | Russell | 175/325 X |

FOREIGN PATENT DOCUMENTS

| | | |
|---|---|---|
| 2575793 | 7/1986 | France . |
| 2579662 | 10/1986 | France . |

*Primary Examiner*—Bruce M. Kisliuk

*Attorney, Agent, or Firm*—Fay, Sharpe, Beall, Fagan, Minnich & McKee

[57] ABSTRACT

The drilling device comprises at least two stabilizers (*7a, 7b, 7c*) spaced apart in the longitudinal direction of the set of rods. The pistons (17*a*, 17*b*, 17*c*) of these stabilizers are interconnected and include common members (35, 37) for creating a pressure drop in the drilling fluid. Actuating surfaces (19*a*, 19*b*, 19*c*) including ramps (40) and complementary parts interconnecting the ramps cooperate with finger members (20) for effecting the extension of the bearing plates (21). The ramps (40) and the complementary parts of the actuating surfaces of the stabilizers (*7a, 7b, 7c*) are aligned in the longitudinal direction and are such that for each stable successive position of the pistons (17*a*, 17*b*, 17*c*), the bearing plates (21) are in positions of extension constituting a combination different from the preceding one.

11 Claims, 3 Drawing Sheets

42a
42b
42c
42
19a
19b
19c
40
40b
40c
41
-18
-2

DRILLING DEVICE HAVING A CONTROLLED PATH

The invention relates to a drilling device having a controlled path and a method for adjusting this path.

French Pat. No. 2,579,662 discloses a drilling device having a controlled path comprising a set of hollow rods in which flows a drilling fluid. A drilling tool is fixed to one of the ends of the set of rods and at least one stabilizing device for controlling the path of the drilling tool is fixed to the set of rods, usually in the vicinity of the tool. The stabilizing device comprises a body connected to the set of rods and having a central bore coaxial with the bore of the rods, at least one bearing plate mounted to be radially movable in the body and a piston mounted in the body to be movable in the axial direction of the bore of the body for actuating the bearing plate in the direction for the radial extraction of the latter. The radial extraction of the bearing plate or plates is achieved by an axial displacement of the piston between an initial position and a final position under the effect of control means having the drilling fluid as source of energy. Elastically yieldable means such as a spring bias the piston to its initial position. Likewise, elastically yieldable means bias the bearing plates to their retracted position.

The piston is mounted to be movable in the central bore of the body of the stabilizing device or stabilizer, not only in translation but also in rotation about the axis of the set of rods. This piston comprises on its outer lateral surface a continuous actuating surface formed by longitudinal ramps inclined in a radial direction relative to the axis of the rods, placed one after the other along the periphery of the piston and interconnected by complementary parts generally having a constant level in the radial direction throughout their length, i.e. they are at a constant distance from the axis of the set of rods throughout their length. These complementary parts ensure both the step-by-step rotation of the piston by the curved parts and the return of the piston to the initial position.

Associated with each of the bearing plates is at least one actuating finger member radially movably mounted in the body of the stabilizer and cooperating on one hand with the actuating surface of the piston and on the other hand with the bearing plate.

Furthermore, the piston and the body of the stabilizer comprise complementary means for creating a pressure drop which is very greatly increased in the circulating drilling fluid at the end of the actuating movement of the piston. A measurement of the pressure of the drilling fluid effected from the surface thus permits detecting and recording the successive displacements of the piston. In this way, it is possible to ascertain at any moment the position of the bearing plates, the sequence of displacement of which in the radial direction is predetermined by the inclination and position of the ramps.

Preferably, the piston is actuated by a device which creates a pressure drop in the circulating drilling fluid.

According to an embodiment whereby it is possible to improve the adjustment of the path, the device comprises at least two stabilizers connected to the set of rods at locations axially spaced apart along the set of rods. By placing the bearing plates of these stabilizers spaced axially along the set of rods in perfectly determined radial extraction positions, it is possible to control the direction of the axis of the set of rods, i.e. the direction of the drilling, the bearing plates coming in contact with the edges of the drilled hole.

In the case of a set of rods comprising a plurality of stabilizers each having a plurality of positions of extraction of their bearing plates, there is consequently available an array capable of providing a number of combinations of positions of extraction of the plates of the different stabilizers located along the set of rods. These different combinations permit, when brought into action, corrections of the path which may be relatively fine and relatively numerous. These actuating means are substantially equivalent to the displacement of a stabilizer having a constant diameter along the set of rods. However, it is quite clear that the actuation of stabilizers having a variable diameter placed in series on the set of rods may be remote-controlled from the surface, whereas the changing of the position of a stabilizer having a fixed diameter along the set of rods requires raising the whole of the set of rods, i.e. stopping the drilling. The control of the path with the use of a plurality of stabilizers therefore presents a very great practical advantage.

However, the remote control of a plurality of independent stabilizers requires the use of complex means.

A fine and diversified action on the drilling direction may then require the use of a complex and costly drilling equipment.

An object of the invention is therefore to propose a drilling device having a controlled path comprising a set of hollow rods in which a drilling fluid flows, a drilling tool fixed to one of the ends of the set of rods and at least two stabilizing devices connected to the set of rods at axially spaced-apart locations along the set of rods, each stabilizing device comprising a body connected to the set of rods and having a central bore coaxial with the bore of the rods, at least one bearing plate mounted in the body to be radially movable in the body, and a piston mounted to be movable in the axial direction of the bore for actuating the bearing plate in the direction for radially extracting the bearing plate by an axial displacement of the piston between an initial position and a final position under the effect of control means employing the drilling fluid as a source of energy, the bearing plate and the piston being returned or biased by elastically yieldable means to their retracted position and their initial position respectively, each of the pistons being mounted to be movable in the central bore of the corresponding body in translation but also in rotation about the axis of the set of rods and including on the outer lateral surface thereof longitudinal ramps inclined in a radial direction relative to the axis of the rods, placed one after the other along the periphery of the piston and interconnected so as to constitute a continuous actuating surface by complementary parts for the step-by-step rotation of the piston and the return of the piston to the initial position thereof by means of an actuating finger member radially movably mounted in the body and cooperating with the actuating surface on one hand and the bearing plate on the other hand, which device permits controlling the stabilizers by simple and inexpensive means while allowing a fine and diversified action on the path of the drilling.

For this purpose, the pistons of the stabilizing devices are of tubular shape and connected to each other and include common means for creating a pressure drop in the drilling fluid and the ramps and the complementary parts constituting the actuating surface of each of the pistons are aligned in the longitudinal direction relative to the ramps and/or the complementary parts of the other pistons, the inclination of the ramps and/or the constant level in the radial direction of the aligned complementary parts being such that, for each stable successive position of the pistons after a rotation about the axis, the bearing plates of the stabilizing devices are in positions of extraction constituting a combination which is different from the preceding one.

In order to explain the invention, there will now be described by way of a non-limitative example a drilling device according to the invention comprising a group of three stabilizers connected to the set of rods at locations axially spaced apart along the set of rods.

Figures 3A, 3B, 3C:
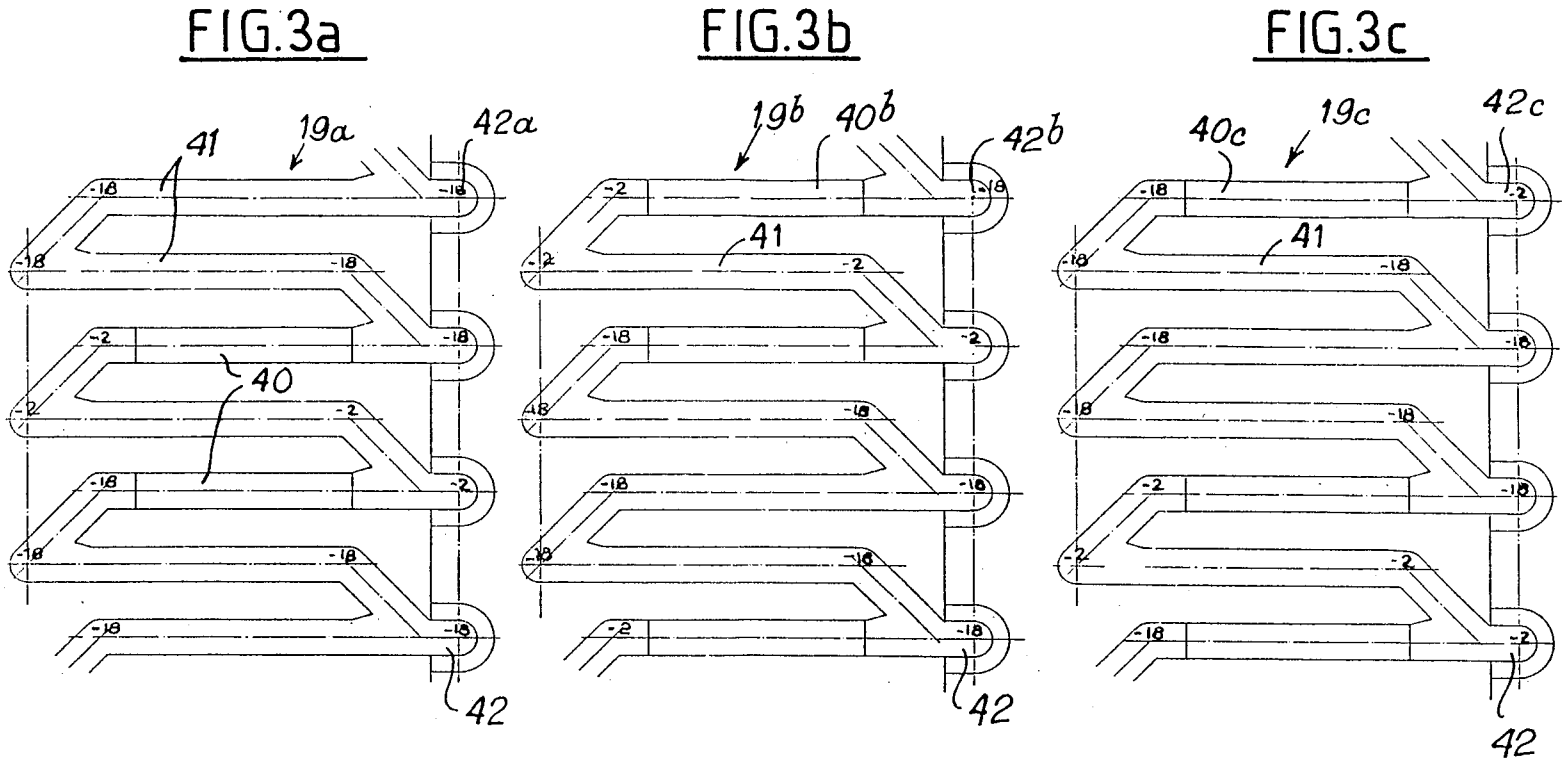

FIG. 3*a* is a developed view of the actuating surface of the piston of the first stabilizer in the direction of flow of the drilling fluid.

FIG. 3*b* is a developed view of the actuating surface of the piston the second stabilizer.

FIG. 3*c* is a developed view of the actuating surface of the piston of the third stabilizer.

Figure 1:
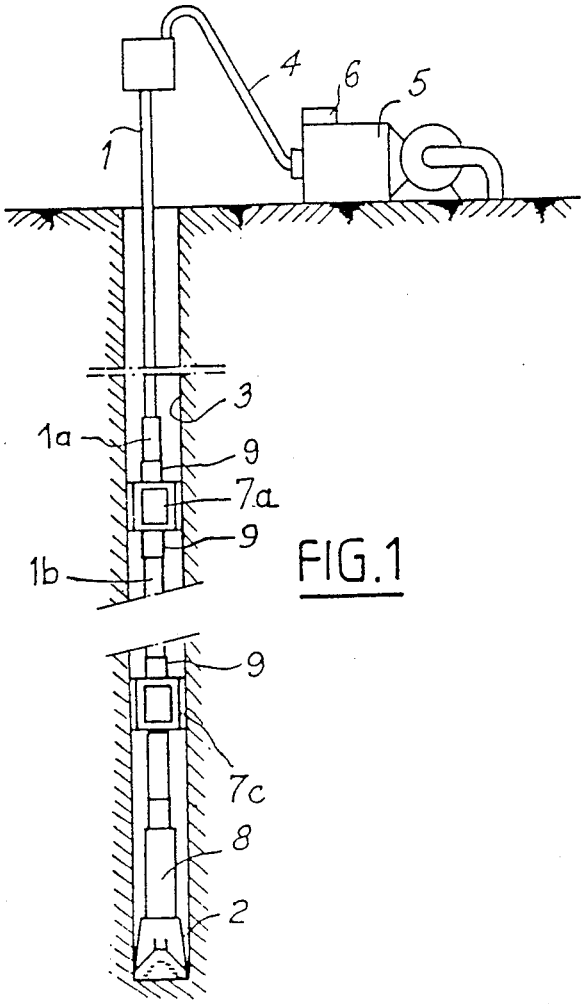
FIG. 1 is a diagrammatic assembly view of a drilling device having a controlled path according to the invention in the operating position.

FIG. 1 shows a drilling installation comprising a set of drilling rods 1 carrying at its lower end a drilling tool 2 and connected at its other end, through a pipe 4,to a pumping unit 5 for injecting drilling mud through the interior of the set of rods 1 at the level of the tool 2 in the operating position at the bottom of the hole 3.

The set of rods 1 comprises successive rods such as 1*a* and 1*b* which are interconnected and connected to the drilling tool 2 by intermediate members. These intermediate members comprise in particular stabilizers 7*a*, 7*c* and junction members 9.

The third stabilizer 7*b* located between the stabilizers 7*a* and 7*c* has not been shown for reasons of simplification.

Placed on the pumping device 5 are measuring means 6 for the pressure of the pumping of the drilling mud.

A measuring unit 8 is associated with the tool and permits in particular taking measurements of orientation of the set of rods 1.

Figure 2:
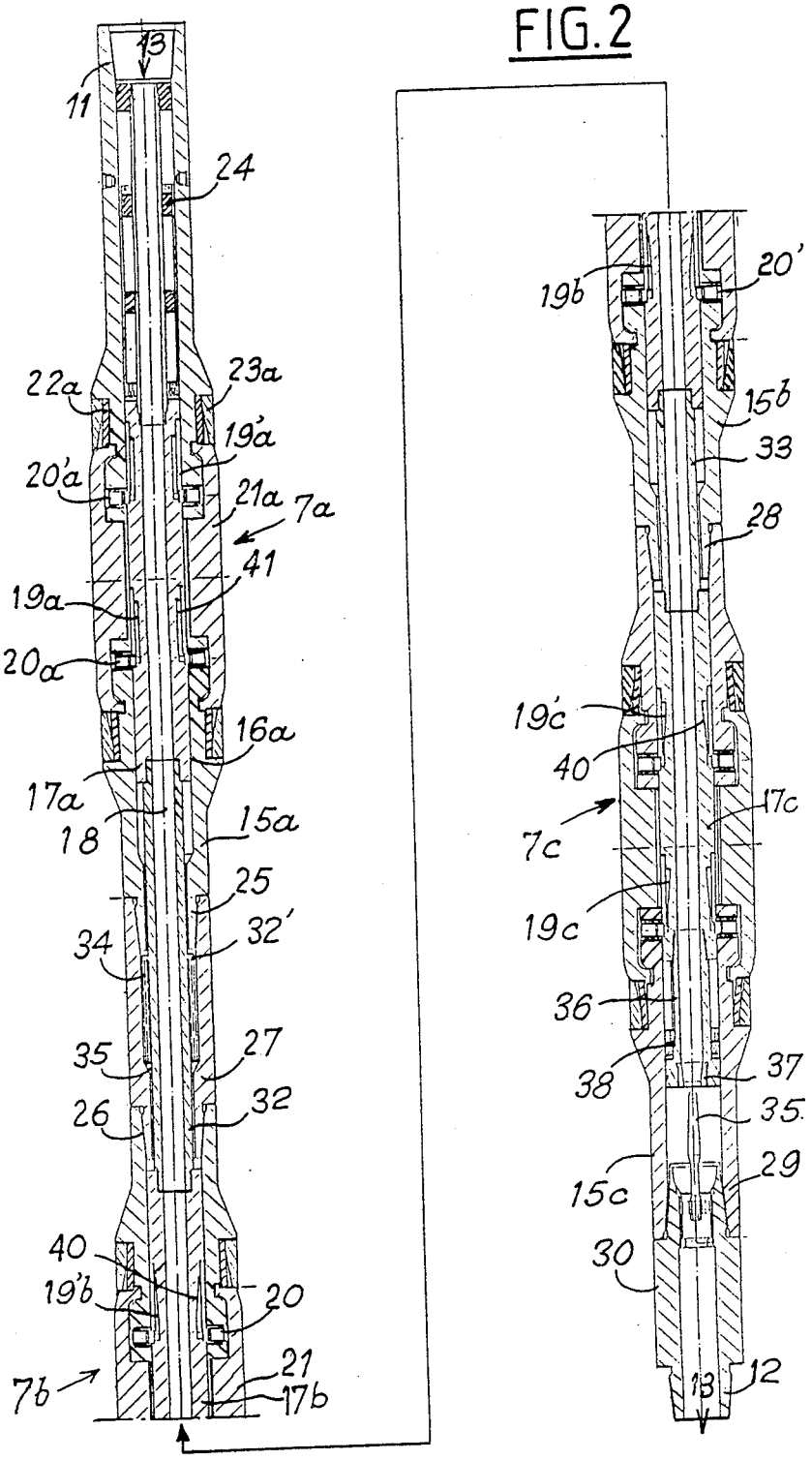
FIG. 2 is a detailed longitudinal sectional view of three stabilizers of the device according to the invention.

In FIG. 2, a part of a set of drilling rods is seen which comprises at one of its ends a female screw-threaded coupling 11 of conical shape and, at its other end, a male screw-threaded coupling 12 which is also of conical shape. The couplings 11 and 12 enable the assembly shown in FIG. 2 to be connected to the set of rods of the drilling device shown in FIG. 1. The screw-threaded coupling 11 or upstream coupling enables the illustrated assembly to be connected to the part of the set of rods effecting its junction with the pumping unit 5 for the drilling fluid which flows in the illustrated assembly in the direction of arrow 13.

The coupling 12, or downstream coupling, enables the assembly to be connected to the part of the set of rods including the drilling tool 2 intended to reach the bottom of the hole.

The coupling 11 may be connected, for example, to a drilling rod and the coupling 12 to the fitting of the tool or to the measuring unit 8 associated with the drilling tool.

The illustrated assembly corresponds to the three successive stabilizers 7*a*, 7*b* and 7*c* disposed in succession in the direction of flow of the drilling fluid, i.e. in the direction from the upstream end to the downstream end.

Only one of the stabilizers will now be described, the others having an identical structure involving corresponding elements. The corresponding elements of the stabilizers 7*a*, 7*b* and 7*c* will be given the same reference characters with the addition of the index a, b or c for indicating that the element pertains to the stabilizer 7*a*, 7*b* or 7*c*.

The stabilizer 7*a* comprises a body 15*a* having a central bore 16*a* whose axis corresponds to the axis 18 of the set of rods. A piston 17*a* is mounted in the bore 16*a* to be both slidable along the axis 18 and rotatable about this axis. The piston 17*a* has a double actuating surface 19*a*, machined as a recess in its lateral wall. The shape of this actuating surface will be described in more detail with reference to FIG. 3*a*.

The axial sectional view of FIG. 2 is a broken section corresponding to two section planes at 120° to each other intersecting on the axis 18 of the set of rods so that the parts of the actuating surfaces 19*a* and 19'*a* shown in FIG. 2 are disposed in planes at each other.

Radially extending actuating finger members 20*a*, 20'*a* are in contact by one of their ends with the actuating surfaces 19*a*, 19'*a* respectively.

The stabilizer 7*a* comprises three finger members such as 20*a* placed at 120° to one another about the axis 18 in cavities provided in the wall of the body 15*a* of the stabilizer. The stabilizer 7*a* further comprises three other finger members 20'*a* placed at 120° to one another about the axis 18.

The finger members 20*a* and 20'*a* are in contact by their ends remote from their ends which cooperate with the actuating surfaces 19*a* and 19'*a* respectively, with three bearing plates 21*a* disposed at 120° to one another and mounted to be movable in the radial direction relative to the body 15*a* of the stabilizer.

The plates 21*a* are returned or biased to the retracted position, i.e. inwardly of the body 15*a*, by spring strips 22*a* which are maintained by closing members 23*a*. The springs 22*a* also maintain the finger members 20*a*, 20'*a* in contact with the actuating surfaces 19*a*, 19'*a* by means of the bearing plates 21*a*.

The actuating surfaces such as 19*a*, 18'*a* include ramps of longitudinal direction inclined in the radial direction relative to the axis 18 of the set of rods. Such inclined ramps 40 can be seen on the actuating surfaces 19*b*, 19'*b* and 19*c* of the stabilizers 7*b* and 7*c* respectively. It will be understood that the cooperation of the ramps of the actuating surfaces and the finger members 20, 20' the stabilizers permits achieving a displacement of the bearing plates 21 in the radial direction, when the piston of the corresponding stabilizer is shifted in a direction along the axis 18.

It can be seen in FIG. 2 that the bodies 15*a*, 15*b* and 15*c* of the stabilizers 7*a*, 7*b* and 7*c* are not identical, at least as concerns their end and connecting part. The body 15*a* of the stabilizer 7*a* has a front part whose end constitutes the coupling 11 and which encloses a guiding assembly 24 for the piston 17*a* when it moves along the axis 18.

The body 15*a* includes, at its end opposed to the coupling 11, a male screw-threaded coupling 25. The body 15*b* of the stabilizer 7*b* includes, at its end extending toward the stabilizer 7*a*, a female screw-threaded coupling 26 of conical shape. A tubular coupling member 27 enables the body 15*a* of the stabilizer 7*a* to be connected to the body 15b of the stabilizer 7b by screw-threaded parts of conical shape corresponding to the screw-threaded couplings 25 and 26 of the bodies 15a and 15b respectively.

The body 15b comprises, at its end opposed to the end constituting the coupling 26, a male screw-threaded coupling 28 of conical shape adapted to cooperate directly with a female screw-threaded coupling of corresponding conical shape machined on one of the ends of the body 15c of the stabilizer 7c.

The body 15c of the stabilizer 7c has at its end opposed to the coupling with the coupling 28 of the body 15b of the stabilizer 7b a conical female screw-threaded coupling 29 on which it is possible to screw-threadedly engage a junction and support member 30 of tubular shape whose end opposed to the coupling 29 constitutes the male screw-threaded coupling 12.

The assembly shown in FIG. 2 and comprising the three stabilizers 7a, 7b and 7c therefore comprises a tubular body formed by the body 15a of the stabilizer 7a, the junction member 27, the body 15b of the stabilizer 7b, the body 15c of the stabilizer 7c and the junction and support member 30, all these elements being interconnected by screw-threaded couplings of conical shape.

The piston 17a, 17b and 17c, disposed inside the bodies 15a, 15b and 15c, respectively, are connected by tubular spacer members 32 and 33 so that they are connected both in translation along the axis 18 and in rotation about this axis 18 in the inner bore of the corresponding stabilizer bodies.

It can be seen that the junction member 27 has an inner bore machined in such manner as to receive a bearing member 35 on which a coil spring 34 disposed around the spacer member 32 bears by one of its ends. The other end of the spring 34 bears against a part 32' of large diameter of the spacer member 32. This spring 34, interposed between the member 27 and the spacer member 32, constitutes a return spring biasing all of the pistons 17a, 17b and 17c interconnected by the spacer members 32 and 33, in the direction along the axis 18 and in the direction opposed to the direction of flow of the drilling fluid indicated by arrow 13.

The junction and support member 30 carries at its end extending toward the interior of the body 15c where the piston 17c is located, a profiled member 35 extending along the axis 18 of the set of rods.

The piston 17c carries at its end extending toward the needle member 35 an extension 36 of tubular shape in the inner bore of which is mounted a profiled ring 37 having such shape and diameter as to enable it to cooperate with the needle member 35 when all of the pistons are displaced in the direction of arrow 13, so as to create a very greatly increased pressure drop in the circulating drilling fluid.

In the initial position of the pistons shown in FIG. 2, the end of the needle member 35 is in proximity to the outlet section of the ring 37.

The extension 36 of the piston 17c also includes a freewheel 38 allowing the rotation of all of the pistons 17a, 17b and 17c only in a single direction about the axis 18.

The piston 17a is connected to a tubular extension constituting a support rod for the guide pistons of the device 24.

FIGS. 3a, 3b and 3c are developed views of the actuating surfaces 19a, 19b and 19c adapted to cooperate with a set of finger members 20a, 20b and 20c respectively for radially shifting the plates 21a, 21b and 21c of the stabilizers 7a, 7b and 7c.

It is clear that the actuating surfaces 19'a, 19'b and 19'c adapted to cooperate with the finger members 20'a, 20'b and 20'c are identical and disposed in the same way as the actuating surfaces 19a, 19b and 19c about the lateral surface of the pistons 17a, 17b and 17c respectively.

FIGS. 3a, 3b and 3c show one third of the actuating surface, the other two thirds being identical and shifted angularly through 120° on the lateral surface of the corresponding piston. Each of the parts shown in FIGS. 3a, 3b and 3c provides a complete cycle of displacement of one of the finger members of the stabilizer.

Furthermore, FIGS. 3a, 3b and 3c, have been arranged with respect to one another in such manner as to indicate the relative positions of the different parts of these actuating surfaces on the pistons 17a, 17b and 17c in respect of their longitudinal alignment.

The horizontal lines of FIGS. 3a, 3b and 3c in coincidence correspond to the generatrices of the outer lateral surface of the pistons 17a, 17b and 17c which are interconnected.

Each of the actuating surfaces comprises ramps 40 inclined in a radial direction relative to the axis 18 of the set of rods and complementary parts 41 interconnecting the ramps 40.

In FIGS. 3a, 3b and 3c, there has been indicated by numerals preceded by the sign—(namely, −2 or −18) the depth in $10^{-3}$ m of the ramp or of the complementary part relative to the nominal lateral surface of the corresponding piston, chosen as a reference.

It can be seen in FIG. 2 that the ramps 40 of the pistons 17b and 17c respectively, visible in this figure, join a zone of shallow depth below the nominal surface of the piston ($2.10^{-3}$ m) to a deeper zone ($18.10^{-3}$ m), i.e. two zones located at a different radial distance from the axis 18 of the set of rods. The developed image of these ramps can be seen at 40b and 40c in FIGS. 3b and 3c respectively.

The junction parts 41 between the ramps of constant depth (namely, $2.10^{-3}$ m or $18.10^{-3}$ m) comprise a straight part extending in a direction parallel to the generatrices of the corresponding piston and a bent or curved part enabling two successive straight parts of the actuating surface extending along generatrices of the piston to be connected. The straight sections and the curved sections of the complementary parts of the actuating surfaces are at a constant level.

The actuating surfaces moreover form, at the downstream end of the straight parts, bearing zones 42 for the actuating finger members 40 corresponding to a stable position of the pistons and therefore to an operating position of the stabilizers.

The depth of the bearing surface 42 has been shown to be below the nominal surface of the piston.

The depth −18 of a zone 42 corresponds to a retracted position of a finger member 20 and of the bearing plate 21, when the finger member is in contact with this bearing zone 42. On the other hand, the depth $-2.10^{-3}$ m corresponds to an extracted position of the finger member and corresponding bearing plate.

In FIG. 2, which corresponds to the positions 42 of the first upper horizontal line of the FIGS. 3a, 3b and 3c, the plates 21a and 21b are in the retracted position and the plate 21c in the extracted position. This corresponds to bearing zones 42a and 42b of the finger members 20*a* and 20*b* located at a depth −18 mm and a bearing zone 42*c* located at a depth of 2 mm.

Hereinafter, position O will designate the retracted position of the finger member and bearing plate corresponding to a cooperation of this finger member with a bearing zone 42 located at level −18 mm.

Likewise, position 1 will designate the extracted position of the finger member and bearing plate when the finger member bears against a zone 42 located at level −2 mm.

The configuration shown in FIG. 2 or in the first horizontal line of FIGS. 3*a*, 3*b* and 3*c* may be represented by the designation 0 0 1.

In the same way, the following configurations corresponding to the successive horizontal lines 2, 3 and 4 of FIGS. 3*a*, 3*b* and 3*c* may be represented by the following designations:

0 1 0; 1 0 0; 0 0 1.

It can be seen that each of the configurations is different from the preceding configuration and that it is possible to obtain as desired any one of the three configurations where one of the stabilizers has its bearing plates in the extracted position and the other two stabilizers have their bearing plates in the retracted position.

These different configurations which enable the drilling direction to be controlled by the use of three stabilizers in series each having two stable operating positions may be obtained by simultaneous displacements of the three interconnected pistons 17*a*, 17*b* and 17*c* under the effect of the circulating drilling fluid and the return spring 34.

It will be assumed that at an initial instant, the device is in the configuration shown in FIG. 2, the bearing finger members 20 being in contact with the bearing zones 42*a*, 42*b* and 42*c* located on the first line of FIGS. 3*a*, 3*b* and 3*c*.

When the drilling fluid circulates in the set of rods and in the inner bore of the pistons 17*a*, 17*b* and 17*c* and the spacer members 32 and 33 with a flow rate corresponding to the normal service flow rate of the set of rods, no movement of the pistons occurs.

In order to bring about a displacement of all of the pistons, the drilling fluid flow rate is raised by acting on the pumping unit located on the surface to a value $Q_{act}$ corresponding to the actuating flow rate. This flow rate $Q_{act}$ which is higher than the usual drilling flow rate, produces a pressure drop in the region of the passage between the ring 37 and the needle member 35 which is sufficient to ensure that the pressure difference on each side of the group of pistons 17*a* and 17*b* causes a displacement of these pistons in the direction of arrow 13. This displacement causes the relative displacement of the finger member 20*a* on the right part 41 of the actuating surface 19*a* at the level −18 and simultaneously, a displacement of the finger members 20*b* and 20*c* on the ramps 40*b* and 40*c* respectively. At the end of the straight parts, the finger members 20*a*, 20*b* and 20*c* come into contact with the curved part of the actuating surface and cause the rotation of all the pistons 17*a*, 17*b* and 17*c*, in the direction allowed by the freewheel 38, i.e. in the direction causing the finger members 20*a*, 20*b* and 20*c* to travel from the first horizontal line to the second horizontal line of FIGS. 3*a*, 3*b* and 3*c*.

The finger members are then released and the pistons can be returned by the spring 34 which was subjected to a compression during the preceding movement, along the complementary parts 40 at a constant level shown at the second line of FIGS. 3*a*, 3*b* and 3*c*.

The movement under the effect of the spring produces a rotation of all of the pistons when the finger members come into contact with the curved part of the corresponding actuating surface located at the end of the sections 41 at constant level. The finger members are thus brought to the stable positions 42 located at the second line of FIGS. 3*a*, 3*c* and 3*c* The device has thus passed from the configuration 0 0 1 to the configuration 0 1 0.

This passage may be perfectly recorded on the surface by a pressure measurement since the passage of the pistons to their advanced position is manifested by a very great increase in pressure, the ring 37 and the needle member 35 cooperating for creating a very high pressure drop on the circulation of the drilling fluid.

The return of the pistons under the effect of the spring 34 is thereafter manifested by a return of the pressure to a normal value.

Thus, it is easy to detect the successive movements of all of the pistons and deduce therefrom the configuration obtained.

Thus, it is possible to program any configuration for effecting a desired correction of the path as a function of the direction of the drilling measured at a certain moment, for example by a measuring device associated with the tool.

This control is effected very simply from the surface and does not require an independent intervention on each of the stabilizers.

The structure of the device permitting effecting these corrections and the control means associated therewith are particularly simple and may be constructed entirely in the mechanical and hydraulic form.

The scope of the invention is not intended to be limited to the embodiment just described.

Thus, there may be used more than three stabilizers in series or, on the contrary, solely two stabilizers and each of the stabilizers may have more than two stable positions, which increases the number of possible combinations of position, i.e. the number of configurations of adjustment of the path.

Actuating means other than the described actuating means involving a pressure drop in the drilling fluid may be imagined.

In any case, common actuating means for all of the pistons will be employed, these pistons remaining interconnected during their displacement, and common means for creating a large pressure drop in the drilling fluid for determining the position of the pistons from the surface.

The stabilizers may be separated by any distance, the lengths of the junction members between the stabilizer bodies and of the spacer members between the pistons being chosen in consequence.

The invention is applicable to any drilling device employing fluid circulating in a set of rods.

The invention also relates to a method for adjusting the path of a drilling tool fixed to the end of a set of rods on which are disposed at least two stabilizing devices, each comprising a body, a set of bearing plates and a member movable in the body for causing the extraction of the bearing plates relative to the body in a radial direction relative to the set of rods.

According to this method, the movable members are actuated simultaneously so as to obtain a desired combination of the positions of extraction of the bearing plates on the stabilizing devices, this combination being chosen from a group of different predetermined combinations each corresponding to a position of the movable members.

We claim:

1. A drilling device having a controlled path comprising:

a set of coaxial rods having an inner bore for receiving a drilling fluid therein, a drilling tool fixed to an end of the set of rods and at least two stabilizing devices connected to the set of rods at locations longitudinally spaced apart along the set of rods, each stabilizing device comprising a body connected to the set of rods and having a central bore coaxial with the bore of the rods, at least one bearing plate mounted to be radially movable in the body between a retracted position and an extended position, and a piston mounted to be movable in translation axially of the bore of the body and in rotation for shifting the bearing plate in a direction for radially extending the bearing plate by said axial displacement of the piston between an initial postion and a final position, control means operatively connected to the piston for controlling the piston and employing said drilling fluid as a source of energy, an elastically yieldable means combined with the at least one bearing plate and the piston for returning the at least one bearing plate to said retracted position and the piston to said initial position thereof, each of the pistons comprising on an outer lateral surface thereof longitudinal ramps which are inclined in a radial direction relative to the axis of the rods and arranged one after the other around the periphery of the respective piston and complementary parts interconnecting the ramps so as to constitute a continuous actuating surface for a step-by-step displacement in rotation of the piston and a return of the piston to said initial position relative to the respective stabilizing device body, and at least one actuating finger member radially movably mounted in the body, interposed between and cooperative with said actuating surface and said at least one bearing plate, said pistons of the stabilizing devices being of tubular shape and being interconnected by at least one tubular longitudinally extending spacer member and including common means for creating a pressure drop in said drilling fluid flowing in said rods, and said ramps and said complementary parts constituting said actuating surface of each piston being aligned in the longitudinal direction relative to the ramps and to the complementary parts of the other piston of said at least two stablilizing devices, wherein the inclination of the ramps and the constant level of said aligned complementary parts are such that, for each stable successive position of the pistons, after a rotation about the axis of the rods, the bearing plates of the at least two stabilizing devices are in positions of extension constituting a combination different from the preceding combination.

2. The device according to claim 1, further comprising at least one longitudinally extending tubular junction member interconnecting the bodies of the at least two stabilizing devices.

3. The device according to claim 2, wherein said elastically yieldable means for returning the pistons comprise a bearing member fixed to an interior of said junction member between the bodies of said at least two successive stabilizing devices, a projecting bearing part of said spacer member between two pistons of said at least two successive stabilizing devices, and a coil spring interposed between and bearing against said bearing member fixed to said junction member and said projecting bearing part of said spacer member.

4. The Device according to claim 1, comprising three of said stabilizing devices, the means for creating a pressure drop in said drilling fluid common to the three pistons comprising a profiled member extending longitudinally along the axis of the set of rods and connected to the body of one of said stabilizing devices and a profiled ring fixed to the piston of said one of said stabilizing devices.

5. The device according to claim 1, comprising a freewheel associated with one of the pistons for allowing the displacement in rotation of the interconnected pistons in only one direction.

6. The device according to claim 1, wherein each of the stabilizing devices comprises three bearing plates disposed at 120° to one another the axis of the body of the corresponding stabilizing device and wherein two actuating finger members are associated with each respective bearing plate.

7. The device according to claim 1, wherein three stabilizing devices are provided, the at least one bearing plate of each of said three stabilizing devices being capable of being placed by the respective actuating finger members and the respective ramps of said actuating surfaces selectively in a retracted position and an extended position relative to the respective body.

8. A drill rod stabilizer assembly, comprising:

a set of coaxial rods having an inner bore for receiving a drilling fluid therein;

at least two stabilizing devices secured to said set of rods in a longitudinally spaced apart manner, each stabilizing device comprising:

a tubular body having a first end and a second end and having a duct extending longitudinally therethrough from said first end to said second end, at least one bearing blade so mounted on an outer periphery of said body as to be radially movable in relation thereto, a piston movably mounted in said duct of said body and actuated by a flow of drilling fluid through said duct, said piston being tubular in shape and having a bore extending longitudinally therethrough which is coaxial with said duct, said piston bore including an orifice portion, said piston also having on its outer surface a plurality of longitudinal grooves which are inclined in a radial direction relative to a longitudinal axis of said body and are connected to one another so as to form a continuous actuating surface for a step by step rotary movement of said piston, a flow restrictor element secured in said duct and disposed coaxially with said piston, said element having a tapered surface which is adapted to cooperate with said piston bore to limit a flow of fluid therethrough wherein a maximum outer diamenter of said flow restrictor element is sufficiently smaller than a minimum internal diameter of said piston bore so as to leave an annular space through which working fluid continues to flow at all positions of said piston, a biasing means means for biasing said piston in one direction, and at least one actuating finger mounted in said tubular body so as to be radially movable in said body as said at least one finger interacts with said bearing blade and said piston; and, at least one tubular longitudinally extending spacer member for interconnecting a first piston of a first of said at least two stabilizing devices with a second piston of a second of said at least two stabilizing devices.

9. The assembly of claim 8 further comprising an elastically yieldable means operatively connected to said at least one bearing blade and said first and second pistons of said at least two stabilizing devices.

10. The assembly of claim 8 further comprising at least one longitudinally extending tubular junction member for interconnecting a tubular body of each of the at least two stabilizing devices.

11. The assembly of claim 8 further comprising a freewheel operatively connected to one of said first and second pistons of the at least two stabilizing devices to allow a rotational displacement of said interconnected pistons only in one direction.

* * * * *